US006260327B1

(12) United States Patent
Pellock

(10) Patent No.: US 6,260,327 B1
(45) Date of Patent: Jul. 17, 2001

(54) STRUCTURAL MEMBER OF A TRUSS

(75) Inventor: Michael A. Pellock, Edwardsville, IL (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/356,537

(22) Filed: Jul. 19, 1999

(51) Int. Cl.[7] ..... E04B 1/32; E04B 1/18
(52) U.S. Cl. ..... 52/643; 52/633; 52/639
(58) Field of Search ..... 52/635, 636, 638, 52/643, 633, 650.1, 653.1, 690, 692, 639

(56) References Cited

U.S. PATENT DOCUMENTS 1,545,168 * 7/1925 Schenck ..... 52/729
2,065,493 * 12/1936 Greulich ..... 52/729
3,349,535 * 10/1967 Balinski ..... 52/634
5,457,927 10/1995 Pellock et al. .
5,485,706 * 1/1996 Menchetti ..... 52/635 X
5,857,306 * 1/1999 Pellock ..... 52/643

* cited by examiner

*Primary Examiner*—Daniel P. Stodola
*Assistant Examiner*—Hugh B. Thompson
(74) *Attorney, Agent, or Firm*—Senniger, Powers, Leavitt & Roedel

(57) ABSTRACT

An elongate structural member of a steel truss. The structural member includes a web, a flange and a cap portion. The web includes a first web section and a second web section. The second web section extends angularly outwardly from a first surface of the web at a first longitudinal edge of the first web section. The flange extends laterally outwardly from the first surface of the web at a second longitudinal edge of the first web section. The flange is configured to be substantially perpendicular to the first web section. The cap portion extends outwardly from a second surface of the web at a distal longitudinal edge of the second web section. The cap portion is configured to be substantially parallel to the flange.

17 Claims, 5 Drawing Sheets

STRUCTURAL MEMBER OF A TRUSS

BACKGROUND OF THE INVENTION

This invention relates generally to steel trusses and more particularly, to a substantially Z-shaped structural member of a steel truss.

Prefabricated steel trusses greatly facilitate the construction of buildings and other structures. Known trusses are essentially planar structures with spans and heights far exceeding their thickness. Trusses generally include a bottom chord, top chords, and web members between the top and bottom chords. Prefabricated steel trusses are very strong and reliable in service and are typically used to meet fire codes, long clear span requirements, or to protect against insect infestation.

The upper and lower chords are structural members of steel trusses. The structural members generally are configured to lie flat for facilitating fabrication of trusses. The upper and lower chords are formed from sheet metal and have a cross sectional shape that provides for resistance to bending and axial stresses under dead and live load conditions. Known structural members of a steel truss are described in U.S. Pat. No. 5,457,927.

While the known structural members of steel trusses provide strength and ease of truss construction, it would be desirable to provide a structural member for a steel truss that is less expensive to fabricate than known structural members while providing the desired strength and ease of truss construction.

BRIEF SUMMARY OF THE INVENTION

These and other objects may be attained by an elongate structural member of a steel truss. The structural member is substantially Z-shaped and includes a web, a flange and a cap portion. The web includes a first web section and a second web section. The second web section extends angularly outwardly from a first surface of the web at a first longitudinal edge of the first web section.

The flange extends laterally outwardly from the first surface of the web at a second longitudinal edge of the first web section. The flange is configured to be substantially perpendicular to the first web section. The cap portion extends outwardly from a second surface of the web at a distal longitudinal edge of the second web section. The cap portion is configured to be substantially parallel to the flange.

A plurality of elongate structural members are used to fabricate a steel truss. Each structural member forms an upper chord or a lower chord. The steel truss includes a bottom chord formed by a structural member positioned so that the cap portion of the structural member forms the bottom edge surface of the truss. Top chords extend angularly from the bottom chord. Each top chord is formed from a structural member positioned so that the cap portion forms the top edge surface of the truss.

The structural member described above is less expensive to fabricate than known structural members, for example, the structural member described in U.S. Pat. No. 5,457,927 because less steel is used. Additionally, the structural member of the present invention while using less steel than known structural members, provides the desired strength and ease of truss construction.

DETAILED DESCRIPTION OF THE INVENTION

Figure 1:
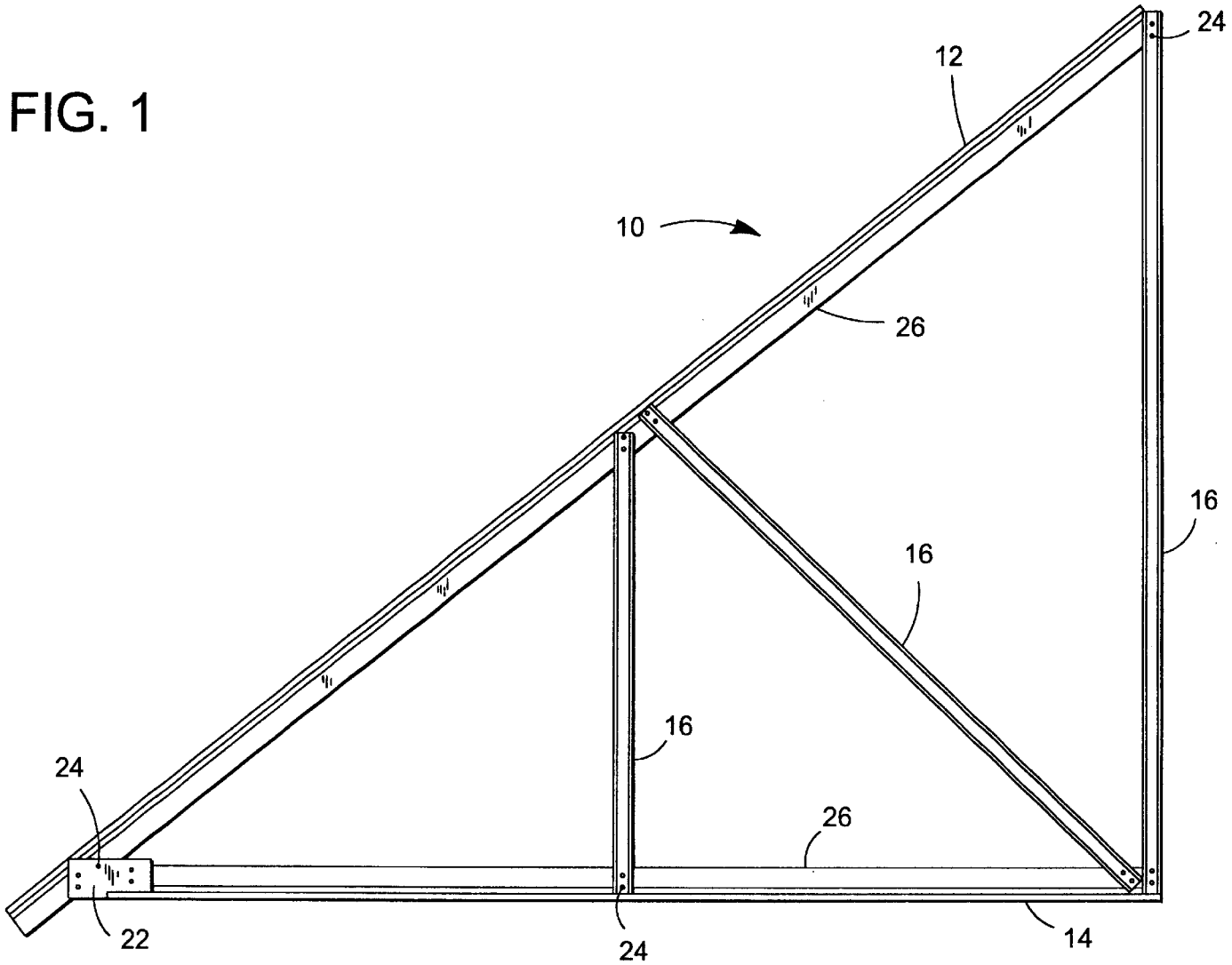
FIG. 1 is a side view of a steel truss in accordance with an embodiment of the present invention.

FIG. 1 is a side view of a steel truss 10 in accordance with an embodiment of the present invention. Truss 10 includes an upper chord 12, a lower chord 14, and a plurality of web members 16 extending between and attached to upper chord 12 and lower chord 14. Truss 10 shown in FIG. 1 has a triangular shape.

Figure 2:
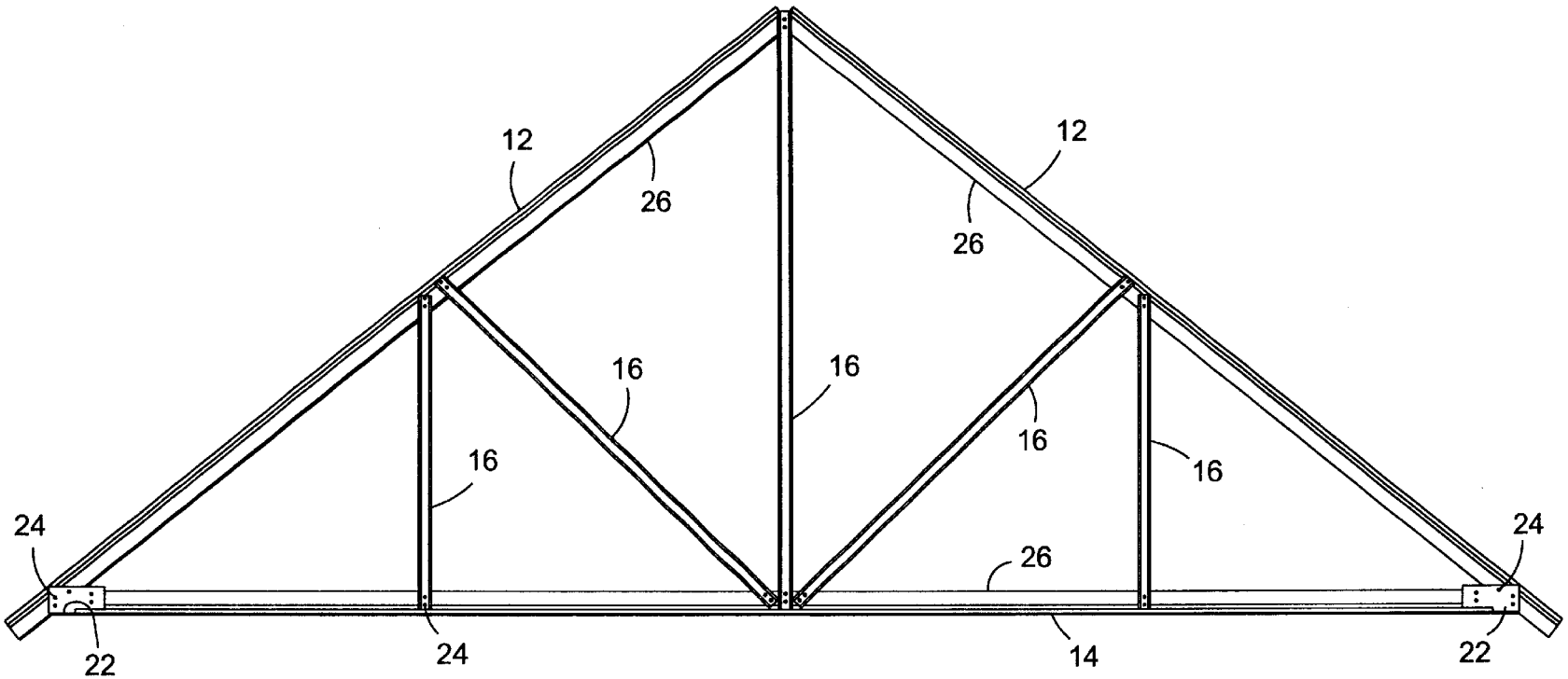
FIG. 2 is a side view of a king post steel truss in accordance with another embodiment of the present invention.

FIG. 2 is a side view of a king post steel truss 18 in accordance with another embodiment of the present invention. Truss 18 includes a plurality of upper chords 12, a lower chord 14, and a plurality of web members 16 extending between and attached to upper chords 12 and lower chord 14. Truss 18 shown in FIG. 2 has a triangular shape.

Figure 3:
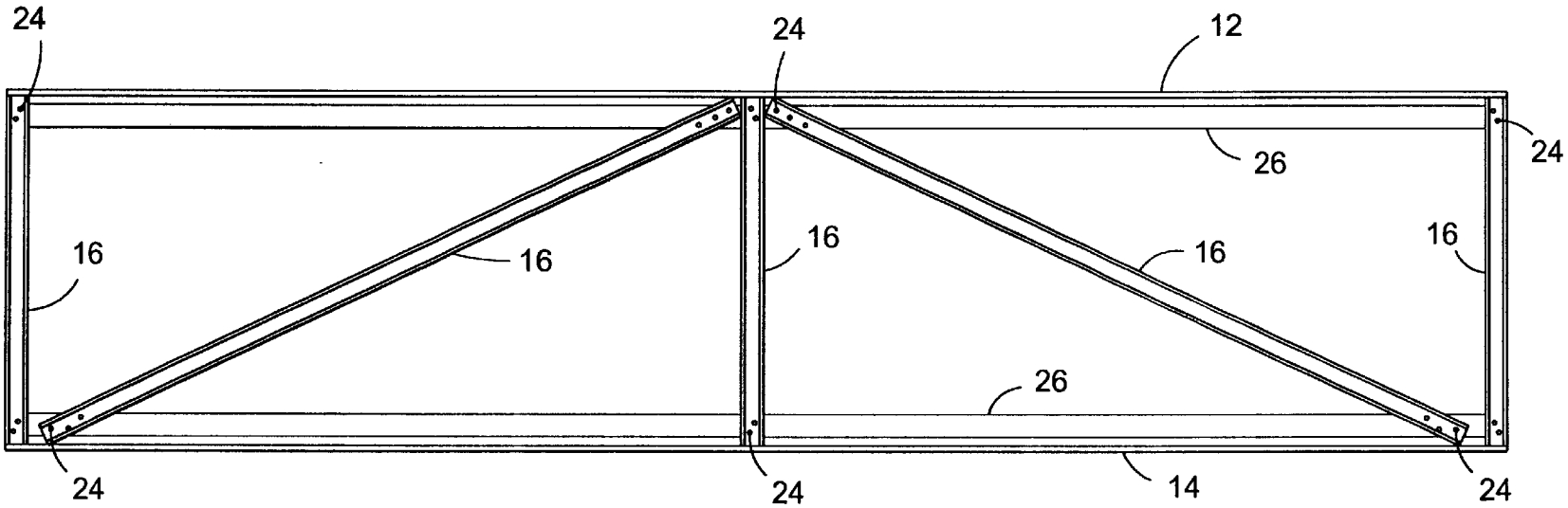
FIG. 3 is a side view of a parallel chord steel truss in accordance with still another embodiment of the present invention.

FIG. 3 is a side view of a parallel chord steel truss 20 in accordance with still another embodiment of the present invention. Truss 20 includes an upper chord 12, a lower chord 14, and a plurality of web members 16 extending between and attached to upper chords 12 and lower chord 14. Truss 20 shown in FIG. 3 has a rectangular shape.

Referring to FIG. 1, Truss 10 also includes a connector plate 22 which couples one end of upper chord 12 to one end of lower chord 14. Connector plate 22 and web members 16 are coupled to upper and lower chords 12 and 14 by a plurality of fasteners 24. Fasteners 24 may be any suitable fastener, for example, screws, bolts and nuts, rivets, and the like.

Upper and lower chords 12 and 14 are identical, and each includes a structural member 26 having a substantially Z-shaped cross section. Structural member 26 is formed by roll forming flat sheet metal stock. Typically structural member 26 is formed from 18 gauge or 20 gauge sheet metal stock, however, thick or thinner gauge sheet metal stock may be used depending on the desired strength and/or stiffness of the structural member. The thickness of 20 gauge sheet metal stock is about 0.91 mm, and the thickness of 18 gauge sheet metal stock is about 1.20 mm.

Figure 4:
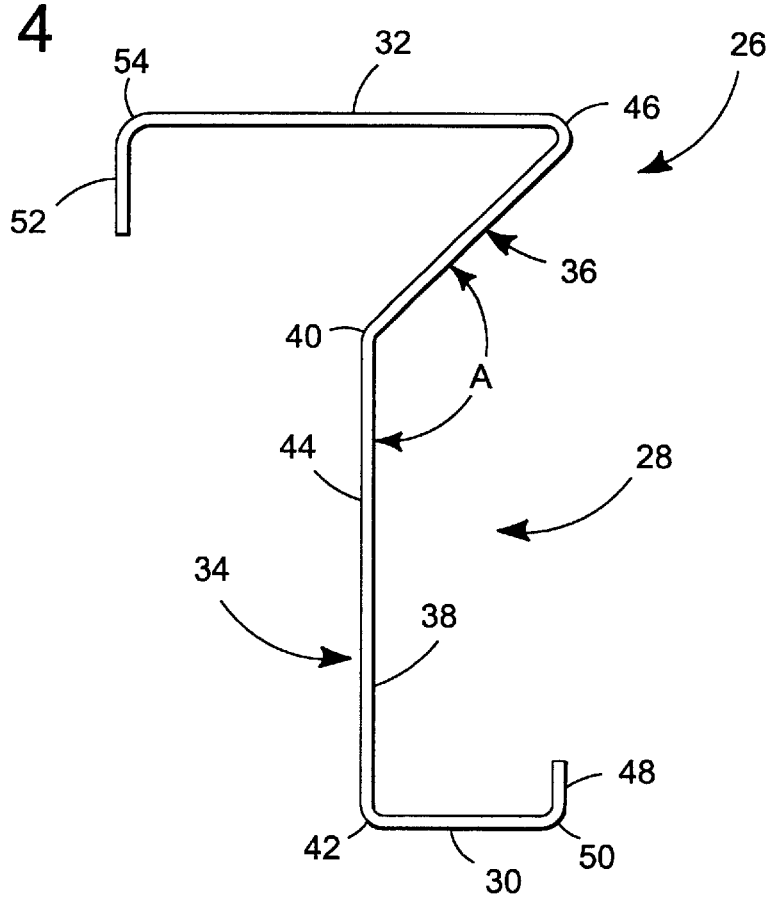
FIG. 4 is a cross sectional view of a structural member of the steel truss shown in FIG. 1.

Referring to FIG. 4, structural member 26 includes a web 28, a flange 30 and a cap portion 32. Web 26 includes a first web section 34 and a second web section 36. Second web section 36 extends outwardly at an angle A from a first surface 38 of web 28 at a first longitudinal edge 40 of first web section 34. Typically, angle A is greater than 90 degrees, more typically, angle A is between about 120 degrees to about 145 degrees. In one embodiment, angle A is 133.63 degrees.

Flange 30 extends laterally outwardly from first surface 38 of web 28 at a second longitudinal edge 42 of first web section 34. Flange 30 is substantially perpendicular to first web section 34.

Cap portion 32 extends outwardly from a second surface 44 of web 28 at a distal longitudinal edge 46 of second web section 36. Cap portion 32 is substantially parallel to flange 30. Flange 30 also includes a lip portion 48 extending perpendicularly from the distal longitudinal edge 50 of flange 30 toward cap portion 32. Cap portion 32 also includes a lip portion 52 extending perpendicularly from the distal longitudinal edge 54 of cap portion 32 toward flange 30.

Figure 5:
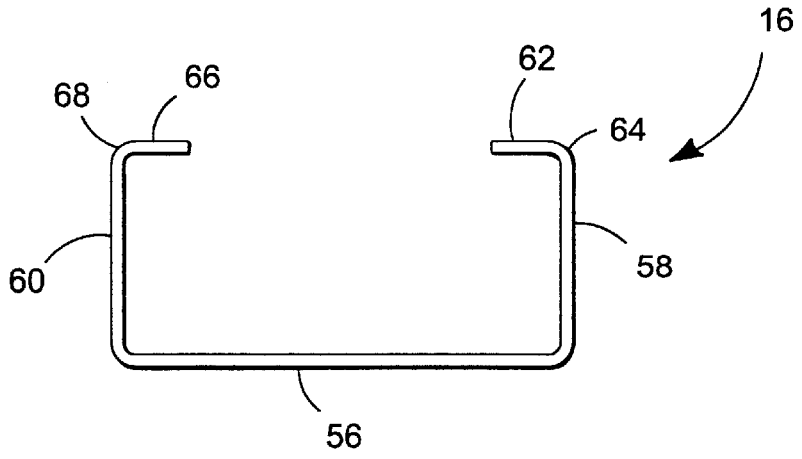
FIG. 5 is a cross sectional view of a web member of the steel truss shown in FIG. 1.

Referring to FIG. 5, web members 16 have a C-shaped cross sectional shape. Each web member 16 includes a web portion 56 with flanges 58 and 60 extending substantially perpendicularly from each end of web portion 56. Flange 58 includes a lip portion 62 extending perpendicularly from the distal end 64 of flange 58 and towards flange 60. Flange 60 includes a lip portion 66 extending perpendicularly from the distal end 68 of flange 60 and towards flange 58. Web member 16 are formed by roll forming sheet metal stock. Typically, 18 or 20 gauge sheet metal stock is used. However, thinner or thicker sheet metal stock may be used depending on the desired strength and/or stiffness of the web member.

Figure 6:
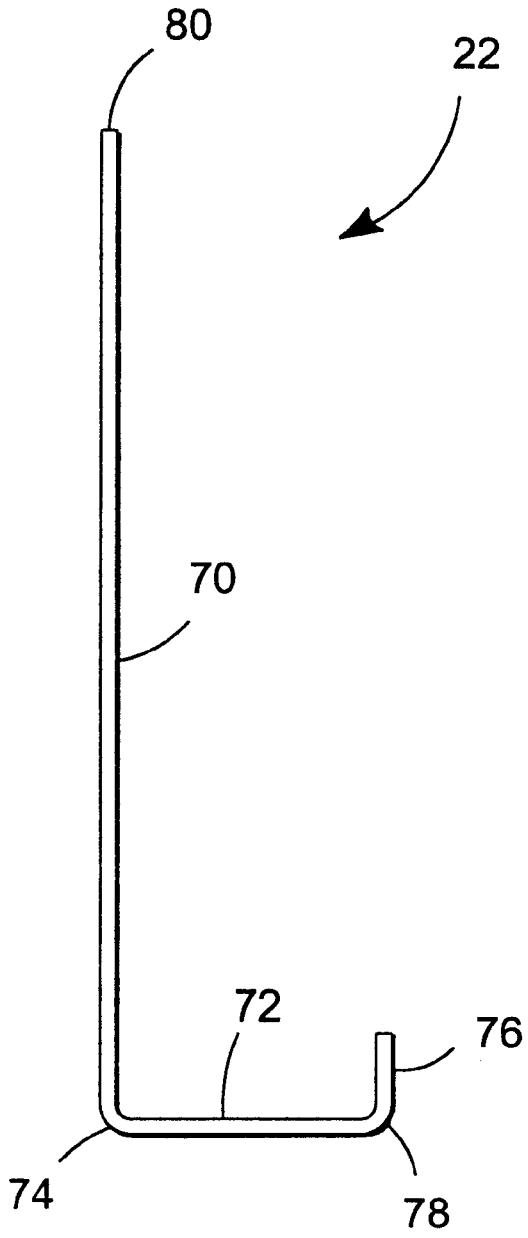
FIG. 6 is a cross sectional view of a connector plate of the steel truss shown in FIG. 1.

Referring to FIG. 6, connector plate 22 has a substantially L-shaped cross sectional shape. Connector plate 22 includes a web portion 70 and a flange 72 extending substantially perpendicularly from a first end 74 of web portion 70. Connector plate 22 also includes a lip portion 76 extending substantially perpendicularly from a distal end 78 of flange 72 and extending toward a second end 80 of web portion 70. Connector plate 22 is formed by roll forming sheet metal stock. Typically, 14 or 16 gauge sheet metal stock is used. However, thinner or thicker sheet metal stock may be used depending on the desired strength and/or stiffness of the connector plate. The thickness of 16 gauge sheet metal stock is about 1.52 mm, and the thickness of 14 gauge sheet metal stock is about 1.90 mm.

Truss 10 is assembled by positioning lower chord 14 so that cap portion 32 forms the bottom of truss 10. Upper chord 12 is coupled to lower chord 14 by connector plate 22. Particularly, connector plate 22 is positioned so that flange 72 contacts cap portion 32 of lower chord 14 and web portion 70 contacts second surface 44 of first web section 34 of lower chord 14. Fasteners 28 extend through web portion 70 of connector plate 22 and first web section 34 of lower chord 14 to attach connector plate 22 to lower chord 14. Upper chord 12 is positioned so that cap portion 32 forms the top of truss 10 and so that flange 30 of upper chord 12 and flange 30 of lower chord 14 extend from the same side of truss 10. Connector plate 22 is positioned so that web portion 70 contacts second surface 44 of first web section 34 of upper chord 12. Fasteners 24 extend through web portion 70 of connector plate 22 and first web section 34 of upper chord 12 to attach connector plate 22 to upper chord 12.

Web members 16 are attached to upper and lower chords 12 and 14 by fasteners 24. Particularly, one end of web portion 56 of web member 16 contacts second surface 44 of first web section 34 of lower chord 14, and the other end of web portion 56 of web member 16 contacts second surface 44 of first web section 34 of upper chord 12. Fasteners 24 extend through web portion 56 and first web section 34 of upper and lower chords 12 and 14 to secure web members 16 to upper and lower chords 12 and 14.

Truss 10 described above is less expensive to fabricate than known trusses because structural members 26 use less steel than, for example, the structural member described in U.S. Pat. No. 5,457,927. Additionally, while using less steel than known structural members, structural member 26 provides the desired strength and the desired ease of truss construction.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An elongate structural member of a steel truss, said structural member comprising:

a web comprising a first surface, a second surface, a first web section and a second web section, said second web section, extending outwardly from said first surface of said web at a first longitudinal edge of said first web section, the first and second web sections defining a nonorthagonal angle therebetween;

a flange extending laterally outwardly from said first surface of said web at a second longitudinal edge of said first web section, said flange substantially perpendicular to said first web section; and a cap portion extending outwardly from the second surface of said web at a distal longitudinal edge of said second web section, said cap portion being substantially parallel to said flange, said cap portion and said second web section also defining a nonorthogonal angle therebetween;

the first web section having a greater length in cross section from longitudinal edge to longitudinal edge than the second web section.

2. A structural member in accordance with claim 1 wherein said second web section extends outwardly at an angle greater than 90 degrees from said first surface of said web at said first longitudinal edge of said first web section.

3. A structural member in accordance with claim 1 wherein said flange comprises a lip section extending perpendicularly from a distal longitudinal edge of said flange toward said cap portion.

4. A structural member in accordance with claim 3 wherein said cap portion comprises a lip section extending perpendicularly from a distal longitudinal edge of said cap portion toward said flange.

5. A steel truss comprising a bottom chord, at least one top chord, and a plurality of web members extending between and attached to said top and said bottom chords, said bottom and said top chord comprising:

a web comprising a first surface, a second surface, a first web section and a second web section, said second web section extending outwardly from said first surface of said web at a first longitudinal edge of said first web section, the first and second web sections defining a nonorthagonal angle therebetween;

a flange extending laterally outwardly from said first surface of said web at a second longitudinal edge of said first web section, said flange substantially perpendicular to said first web section; and a cap portion extending outwardly from the second surface of said web at a distal longitudinal edge of said second web section, said cap portion being substantially parallel to said flange, said cap portion and said second web section also defining a nonorthogonal angle therebetween;

the first web section having a greater length in cross section front longitudinal edge to longitudinal edge than the second web section.

6. A truss in accordance with claim 5 wherein said second web section extends outwardly at an angle greater than 90 degrees from said first surface of said web at said first longitudinal edge of said first web section.

7. A truss in accordance with claim 5 wherein said flange comprises a lip section extending perpendicularly from a distal longitudinal edge of said flange toward said cap portion.

8. A truss in accordance with claim 7 wherein said cap portion comprises a lip section extending perpendicularly from a distal longitudinal edge of said cap portion toward said flange.

9. A truss in accordance with claim 5 wherein each web member comprises an elongate web portion and a flange extending substantially perpendicularly from opposed side edge of said web portion, said web member having a substantially C-shaped cross section.

10. A truss in accordance with claim 9 wherein each web member further comprises a lip portion extending perpendicularly from a distal longitudinal edge of each said flange, said lip portions extending toward said opposed flange.

11. A truss in accordance with claim 9 wherein a first end of said web portion of said web member overlies said second surface of said first web section of said upper chord, and a second end of said web portion of said web member overlies said second surface of said first web section of said lower chord.

12. A truss in accordance with claim 11 wherein said truss further comprises a plurality of fasteners extending through said first end of said web portion of said web member and said first web section of said upper chord, and a plurality of fasteners extending through said second end of said web portion of said web member and said first web section of said lower chord.

13. A truss in accordance with claim 5 further comprising a connector plate connected to an end of said lower chord and an end of said upper chord.

14. A method of assembling a steel truss, the steel truss comprising a bottom chord, at least one top chord, and a plurality of web members extending between and attached to the top and bottom chords, each bottom and top chord comprising:

a web comprising a first surface, a second surface, a first web section and a second web section, the second web section, extending outwardly from the first surface of the web at a first longitudinal edge of the first web section, the first and second web sections defining a nonorthagonal angle therebetween;

a flange extending laterally outwardly from the first surface of the web at a second longitudinal edge of the first web section, the flange substantially perpendicular to the first web section; and a cap portion extending outwardly from the second surface of the web at a distal longitudinal edge of the second web section, the cap portion being substantially parallel to said flange, said cap portion and said second web section also defining a nonorthogonal angle therebetween;

the first web section having a greater length in cross section than the second web section from longitudinal edge to longitudinal edge;

said method comprising the steps of:

positioning the lower chord so that the cap portion forms the bottom of the truss;

positioning at least one top chord so that the cap portion forms the top of the truss; and coupling at least one web member to the upper chord and to the lower chord.

15. A method in accordance with claim 14 wherein each web comprises an elongate web portion and a flange extending substantially perpendicularly from opposed side edge of the web portion, the web member having a substantially C-shaped cross section.

16. A method in accordance with claim 15 wherein coupling at least one web member to the upper chord and to the lower chord comprises the steps of:

positioning a first end of the web portion of web member so that the web portion overlies the second surface of the first web section of the upper chord; and positioning a second end of the web portion of the web member so that the web portion overlies the second surface of the first web section of the lower chord.

17. A method in accordance with claim 16 wherein coupling at least one web member to the upper chord and to the lower chord comprises the steps of:

extending a plurality of fasteners through the first end of the web portion of the web member and the first web section of the upper chord to couple the web member to the upper chord; and extending a plurality of fasteners through the second end of the web portion of the web member and the first web section of the lower chord to couple the web member to the lower chord.

* * * * *